US009947253B2

(12) United States Patent
Cho et al.

(10) Patent No.: US 9,947,253 B2
(45) Date of Patent: Apr. 17, 2018

(54) DISPLAY DEVICE AND METHOD OF INSPECTING THE SAME

(71) Applicant: Samsung Display Co., Ltd, Yongin-si, Gyeonggi-do (KR)

(72) Inventors: Se Hyoung Cho, Yongin-si (KR); Dong Woo Kim, Yongin-si (KR); Kyung Hoon Kim, Yongin-si (KR); Il Gon Kim, Yongin-si (KR); Kang Moon Jo, Yongin-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 100 days.

(21) Appl. No.: 14/976,024

(22) Filed: Dec. 21, 2015

(65) Prior Publication Data

US 2016/0247430 A1 Aug. 25, 2016

(30) Foreign Application Priority Data

Feb. 24, 2015 (KR) ..... 10-2015-0026068

(51) Int. Cl.
*G09G 3/36* (2006.01)
*G09G 3/00* (2006.01)

(52) U.S. Cl.
CPC ..... *G09G 3/006* (2013.01); *G09G 3/3677* (2013.01); *G09G 2310/0286* (2013.01); *G09G 2310/08* (2013.01); *G09G 2330/08* (2013.01); *G09G 2330/10* (2013.01); *G09G 2330/12* (2013.01)

(58) Field of Classification Search
CPC ..... G09G 2310/0286; G09G 2310/08; G09G 2330/08; G09G 2330/10; G09G 2330/12; G09G 3/006; G09G 3/3677; G09G 3/3266; G02F 2001/136254; G02F 1/1309; G02F 1/136259; G02F 2001/136263; G02F 2001/136268; G06F 3/0412; G06F 2203/04103; G06Q 50/22
See application file for complete search history.

(56) References Cited

U.S. PATENT DOCUMENTS 5,285,150 A * 2/1994 Henley ..... G01R 31/308 324/73.1
5,363,037 A * 11/1994 Henley ..... G01R 31/308 324/750.3
5,391,985 A * 2/1995 Henley ..... G01R 31/308 324/73.1

(Continued)

FOREIGN PATENT DOCUMENTS

JP 2002-23712 A 1/2002
JP 2005-098901 4/2005

(Continued)

*Primary Examiner* — Michael J Jansen, II
(74) *Attorney, Agent, or Firm* — Innovation Counsel LLP

(57) ABSTRACT

There are provided a display device capable of detecting a defect of a scan driver. The display device includes pixels positioned in regions demarcated by scan lines and data lines, a scan driver including a plurality of stages connected to the scan lines, an inspection unit connected to the stages to detect whether the stages are defective, and including first transistors turned on when a control signal is supplied, and a timing controller supplying the control signal, wherein the timing controller detects a position of a defective stage by reducing a period during which the control signal is supplied.

10 Claims, 11 Drawing Sheets

(56) References Cited

U.S. PATENT DOCUMENTS 5,570,011 A * 10/1996 Henley ..... G01R 31/308 324/73.1
5,608,558 A * 3/1997 Katsumi ..... G09G 3/006 324/760.02
5,774,100 A * 6/1998 Aoki ..... G09G 3/006 345/87
6,025,891 A * 2/2000 Kim ..... G02F 1/136204 349/40
6,064,222 A * 5/2000 Morita ..... G09G 3/006 324/73.1
6,275,061 B1 * 8/2001 Tomita ..... G09G 3/006 324/760.02
6,525,556 B2 * 2/2003 Matsueda ..... G09G 3/006 324/750.3
6,545,500 B1 * 4/2003 Field ..... G09G 3/006 324/750.12
6,624,857 B1 * 9/2003 Nagata ..... G02F 1/1309 349/139
6,750,926 B2 * 6/2004 Ohgiichi ..... G02F 1/1345 324/760.01
6,882,378 B2 * 4/2005 Nagata ..... G02F 1/1309 349/139
6,956,396 B2 * 10/2005 Lai ..... G09G 3/006 324/760.02
7,129,998 B2 * 10/2006 Ohgiichi ..... G02F 1/1345 349/149
7,358,756 B2 * 4/2008 Kim ..... G02F 1/1303 324/750.3
7,385,413 B2 * 6/2008 Miyagawa ..... G09G 3/006 324/750.3
7,768,291 B2 * 8/2010 Yanagisawa ..... G09G 3/006 324/760.01
7,948,459 B2 * 5/2011 Ohtomo ..... G02F 1/1368 345/100
7,956,946 B2 * 6/2011 Yang ..... G09G 3/006 324/750.3
8,018,142 B2 * 9/2011 Kwak ..... G09G 3/006 313/504
8,138,781 B2 * 3/2012 Wang ..... G09G 3/006 324/760.02
8,179,360 B2 5/2012 Chin
8,330,691 B2 * 12/2012 Tanimoto ..... G02F 1/136286 345/92
8,624,813 B2 1/2014 Cho et al.
8,937,584 B2 * 1/2015 Kwak ..... G09G 3/006 345/80
9,502,393 B2 * 11/2016 Shin ..... G02F 1/1309
9,588,387 B2 * 3/2017 Lv ..... G09G 3/006
9,653,368 B2 * 5/2017 Kwak ..... H01L 22/14
2001/0020988 A1 * 9/2001 Ohgiichi ..... G02F 1/1345 349/54
2001/0048318 A1 * 12/2001 Matsueda ..... G09G 3/006 324/750.3
2002/0075248 A1 6/2002 Morita et al.
2004/0017531 A1 * 1/2004 Nagata ..... G02F 1/1309 349/139
2004/0233344 A1 * 11/2004 Ohgiichi ..... G02F 1/1345 349/40
2005/0146349 A1 * 7/2005 Lai ..... G09G 3/006 324/760.02
2006/0176072 A1 * 8/2006 Kim ..... G02F 1/1303 324/750.3
2007/0001711 A1 * 1/2007 Kwak ..... G09G 3/006 324/762.07
2007/0040572 A1 * 2/2007 Miyagawa ..... G09G 3/006 324/750.3
2008/0001885 A1 * 1/2008 Yanagisawa ..... G09G 3/006 345/92
2008/0036711 A1 * 2/2008 Kwak ..... G09G 3/006 345/82
2008/0123012 A1 * 5/2008 Ohtomo ..... G02F 1/1368 349/54
2009/0045732 A1 * 2/2009 Kwak ..... G09G 3/006 313/504
2009/0213288 A1 * 8/2009 Chen ..... G02F 1/1303 349/43
2009/0231255 A1 * 9/2009 Tanimoto ..... G02F 1/136286 345/87
2010/0073009 A1 * 3/2010 Wang ..... G09G 3/006 324/537
2011/0043500 A1 * 2/2011 Kwak ..... G09G 3/006 345/206
2011/0079789 A1 * 4/2011 Yanagisawa ..... G09G 3/006 257/72
2012/0001950 A1 * 1/2012 Kim ..... G09G 3/3291 345/690
2013/0155033 A1 6/2013 Jin et al.
2013/0265069 A1 * 10/2013 Deng ..... G09G 3/006 324/750.3
2016/0064364 A1 * 3/2016 Shin ..... G02F 1/1309 257/88
2016/0247430 A1 * 8/2016 Cho ..... G09G 3/006
2017/0047017 A1 * 2/2017 Shirouzu ..... G09G 3/20

FOREIGN PATENT DOCUMENTS

KR 10-2005-0104575 A 11/2005
KR 10-2006-0031333 A 4/2006
KR 10-2008-0083960 A 9/2008

* cited by examiner

DISPLAY DEVICE AND METHOD OF INSPECTING THE SAME

CROSS-REFERENCE TO RELATED APPLICATION

This application claims priority to and the benefit of Korean Patent Application No. 10-2015-0026068, filed on Feb. 24, 2015 in the Korean Intellectual Property Office, the entire contents of which are incorporated herein by reference in their entirety.

BACKGROUND

1. Field

The present invention relates to a display device and a method of inspecting the same.

2. Description of the Related Art

Today, information is available and accessible more than ever before. This ready access to information makes display devices important, as they are integrated into various media for relaying and receiving information. In line with this development, display devices such as a liquid crystal display (LCD), an organic light emitting display device, or a plasma display panel (PDP) have been increasingly used.

SUMMARY

An embodiment of the disclosure relates to a display device capable of detecting a defect of a scan driver by using output voltages (i.e., scan signals) of stages forming the scan driver, and a method of inspecting the same.

A display device according to an embodiment of the present invention includes pixels positioned in regions demarcated by scan lines and data lines; a scan driver including a plurality of stages connected to the scan lines; an inspection unit connected to the stages to detect whether the stages are defective, and including first transistors turned on in response to receiving a control signal; and a timing controller supplying the control signal, wherein the timing controller detects a position of a defective stage by reducing a period during which the control signal is supplied.

A first electrode of ith first transistor may be connected to an output terminal of ith stage wherein i is a natural number.

The inspection unit may include ith second transistor whose first electrode is connected to an output terminal of the ith stage and gate electrode is connected to a second electrode of the ith first transistor.

The inspection unit may include ith second transistor whose gate electrode and first electrode are connected to a second electrode of the ith first transistor.

The timing controller may supply the control signal during a period in which a scan signal is supplied in every stages, and when at least one stage is defective, the timing controller may detect a final defective stage, while reducing a supply period of the control signal.

A display device according to an embodiment of the present invention includes pixels positioned in regions demarcated by scan lines and data lines; a scan driver including stages connected to the scan lines; an inspection unit including first transistors respectively connected to the stages to detect whether the stages are defective and second transistors respectively connected to the first transistors and turned on when a control signal is supplied; and a timing controller supplying the control signal, wherein the timing controller detects a position of a defective stage by reducing a period during which the control signal is supplied.

A gate electrode of ith first transistor may be connected to an output terminal of ith stage, first electrodes of first transistors connected to odd-numbered stages may be connected to a first voltage source, and first electrodes of first transistors connected to even-numbered stages may be connected to a second voltage source having a voltage different from a voltage of the first voltage source wherein i is a natural number.

A first electrode of ith second transistor may be connected to a second electrode of the ith first transistor.

The timing controller may supply the control signal during a period in which a scan signal is supplied in every stages, and when at least one stage is defective, the timing controller may detect a final defective stage, while reducing a supply period of the control signal.

A method of inspecting a display device including stages for supplying a scan signal according to an embodiment of the present invention includes setting first transistors respectively connected between a detect line and the stages to an ON state by supplying a control signal; and inspecting whether the stages are defective by using a voltage supplied to the detect line, wherein when at least one of the stages is determined to be defective, a position of the defective stage is detected, while reducing a supply period of the control signal at least one time.

After inspecting whether the stages are defective, the detect line may be cut away from a panel.

After inspecting whether the stages are defective, the detect line and the first transistors may be cut away from the panel.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will full convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
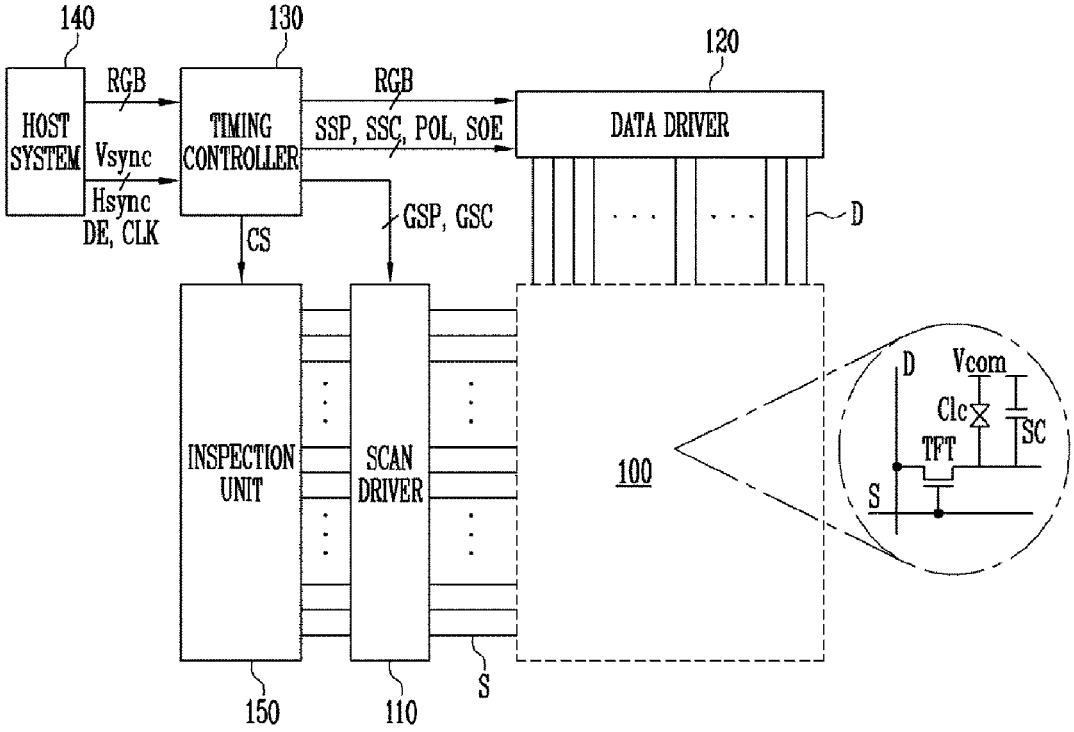
FIG. 1 is a block diagram schematically illustrating a display device according to an embodiment of the inventive concept.

Hereinafter, embodiments of the inventive concept and will be described in detail with reference to the accompanying drawings such that a person skilled in the art easily understands the concept. However, since the inventive concept may be implemented in various forms within the scope of the claims, the embodiment described hereinafter is intended to be illustrative rather than restrictive.

That is, the inventive concept is not limited to the embodiments disclosed hereinafter but may be implemented in various forms. It will be understood that when an element is referred to as being "connected to" another element, it can be directly connected to the other element or intervening elements may also be present. In contrast, when an element is referred to as being "directly connected to" another element, no intervening elements are present. Also, in the drawings, like reference numerals refer to like elements although they are illustrated in different drawings.

FIG. 1 is a block diagram schematically illustrating a display device according to an embodiment. Although the display device is described as being a liquid crystal display for simplicity of description, this is not a limitation of the inventive concept and other types of suitable display devices may be used.

Referring to FIG. 1, the display device according to an embodiment includes a pixel unit 100, a scan driver 110, a data driver 120, a timing controller 130, a host system 140, and an inspection unit 150.

The pixel unit 100 refers to an effective display unit of a liquid crystal panel. The liquid crystal panel includes a thin film transistor (TFT) substrate and a color filter substrate. A liquid crystal layer is formed between the TFT substrate and the color filter substrate. Data lines D and scan lines S are formed on the TFT substrate, and a plurality of pixels are disposed in regions divided by the scan lines S and the data lines D.

A TFT included in each of the pixels transfers a voltage of a data signal supplied by way of the data line D in response to a scan signal from the scan line S to a liquid crystal capacitor Clc. To this end, a gate electrode of each TFT is connected to the scan line S and a first electrode thereof is connected to the data line D. A second electrode of each TFT is connected to the liquid crystal capacitor Clc and a storage capacitor SC.

Here, the first electrode refers to any one among a source electrode and a drain electrode of each TFT, and the second electrode refers to an electrode different from the first electrode. For example, when the first electrode is set as a source electrode, the second electrode may be set as a drain electrode. Also, the liquid crystal capacitor Clc is expressed as being equivalent to a liquid crystal between a pixel electrode (not shown) and a common electrode formed on the TFT substrate. The storage capacitor SC maintains a voltage of the data signal transferred to the pixel electrode for a predetermined period of time until a next data signal is supplied.

A black matrix and a color filter are formed on the color filter substrate.

The common electrode is formed on the color filter substrate in a twisted nematic (TN) mode and a vertical alignment (VA) mode, and formed on a lower glass substrate together with a pixel electrode in an in-plane switching (IPS) mode and a fringe field switching (FFS) mode. Here, a liquid crystal mode of a liquid crystal panel may be implemented as any liquid crystal mode as well as in the TN mode, the VA mode, the IPS mode, and the FFS mode.

The data driver 120 converts video data RGB input from the timing controller 130 into a positive polarity/negative polarity gamma compensation voltage to generate positive polarity/negative polarity analog data voltages. The positive polarity/negative polarity analog data voltages generated by the data driver 120 are supplied as data signals to the data lines D.

Figure 2:
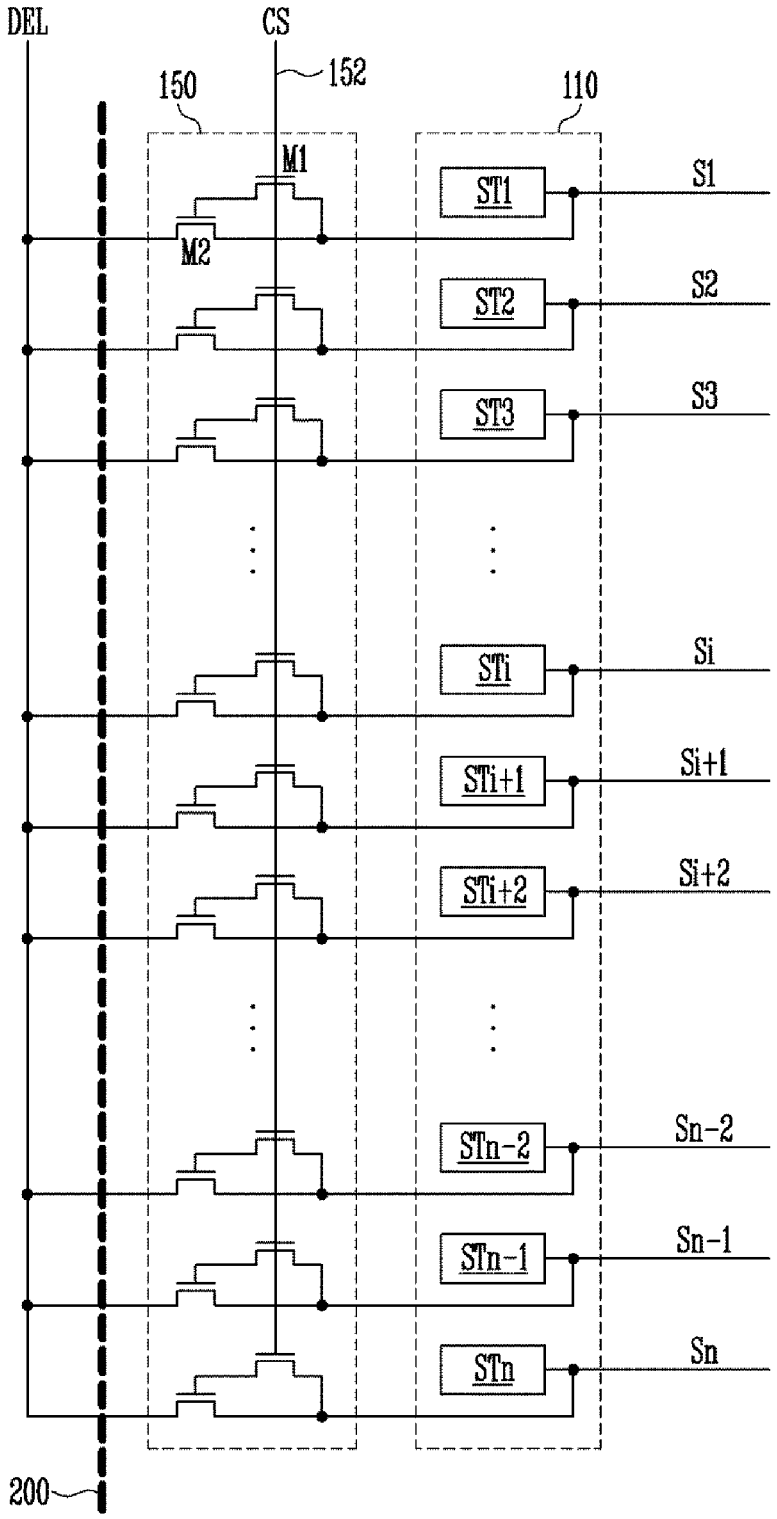
FIG. 2 is a view illustrating a first embodiment of the inspection unit of FIG. 1.

The scan driver 110 supplies a scan signal to the scan lines S. For example, the scan driver 110 may sequentially supply a scan signal to the scan lines S. When the scan signal is sequentially supplied to the scan lines S, pixels are selected by horizontal line and pixels selected by the scan signal receive a data signal. To this end, as illustrated in FIG. 2, the scan driver 110 includes a stage ST connected to each scan line S. The scan driver 110 may be mounted as an amorphous silicon gate (ASG) driver on a liquid crystal panel. That is, the scan driver 110 may be mounted on a TFT substrate through a thin film process. Also, the scan driver 110 may be mounted on both sides of the liquid crystal panel with the pixel unit 100 interposed therebetween.

The timing controller 130 supplies a gate control signal to the scan driver 110 on the basis of timing signals such as video data RGB, a vertical synchronization signal Vsync, a horizontal synchronization signal Hsync, a data enable signal DE, and a clock signal CLK output from the host system 140, and supplies a data control signal to the data driver 120. Also, the timing controller 130 supplies a control signal CS to the inspection unit 150.

The gate control signal includes a gate start pulse GSP and one or more gate shift clocks GSC. The gate start pulse GSP controls a timing of a first scan signal. The one or more gate shift clocks GSC are used as a clock signal for shifting the gate start pulse GSP.

The data control signal includes a source start pulse SSP, a source sampling clock SSC, a source output enable SOE, and a polarity control signal POL. The source start pulse SSP controls a data sampling start point of the data driver 120. The source sampling clock SSC controls a sampling operation of the data driver 120 with respect to a rising or falling edge. The source enable signal SOE controls an output timing of the data driver 120. The polarity control signal POL reverses polarity of a data signal output from the data driver 120 at each j (j is a natural number) horizontal period. Here, video data RGB to be input to the data driver 120 is transmitted in a mini low voltage differential signaling (LVDS) interface standard, the source start pulse SSP and the source sampling clock (SSC) may be omitted.

The host system 120 supplies the video data RGB to the timing controller 130 through an interface such as LDVS or transition minimized differential signaling (TMDS). Also, the host system 140 supplies the timing signals Vsync, Hsync, DE, and CLK to the timing controller 130.

The inspection unit 150 inspects the stages ST included in the scan driver 110. In particular, the inspection unit 150 may detect a defect of the scan driver 110 before liquid crystal is injected after the scan driver 110 is formed, and thus, manufacturing cost may be reduced.

FIG. 2 is a view illustrating a first embodiment of the inspection unit of FIG. 1.

Referring to FIG. 2, the scan driver 110 includes stages ST1 to STn. Each of the stages ST1 to STn is connected to any one of scan lines S1 to Sn. That is, ith stage STi (i is a natural number) is connected to an ith scan line Si and supplies a scan signal to the ith scan line Si. To this end, each of the stages ST1 to STn includes a plurality of transistors, and supplies a scan signal to the scan line (any one of S1 to Sn) in response to the source start pulse SSP and the source sampling clock SSC.

The inspection unit 150 includes a first transistor M1 and a second transistor M2 connected to an output terminal (i.e., a terminal connected to the scan line) of each of the stages ST1 to STn.

A first electrode of the first transistor M1 positioned in an ith horizontal line is connected to an output terminal of the ith stage STi, and a second electrode is connected to a gate electrode of the second transistor M2 positioned in the ith horizontal line. The first transistor M1 is turned on when the control signal CS is received, and turned off when the control signal CS is not received. Here, when the control signal CS is received, it indicates that a voltage (e.g., a high voltage) for turning on the first transistor M1 is supplied to a control line 152 supplying the control signal CS, and when the control signal CS is not supplied, it means that a voltage (e.g., a low voltage) for turning off the first transistor M1 is supplied to the control line 152.

A first electrode of the second transistor M2 positioned in the ith horizontal line is connected to an output terminal of the ith stage STi, and the second electrode is connected to a detect line DEL. A gate electrode of the second transistor M2 positioned in the ith horizontal line is connected to the second electrode of the first transistor M1 positioned in the ith horizontal line. In this case, when the first transistor M1 is turned on, the second transistor M2 is connected in the form of a diode such that a current is supplied from the stage STi to the detect line DEL.

The detect line DEL receives a scan signal from the stages ST1 to STn during an inspection period. A voltage of the scan signal supplied to the detect line DEL during the inspection period is checked to detect whether the scan driver 110—that is, stages ST1 to STn—is defective.

Figure 3:
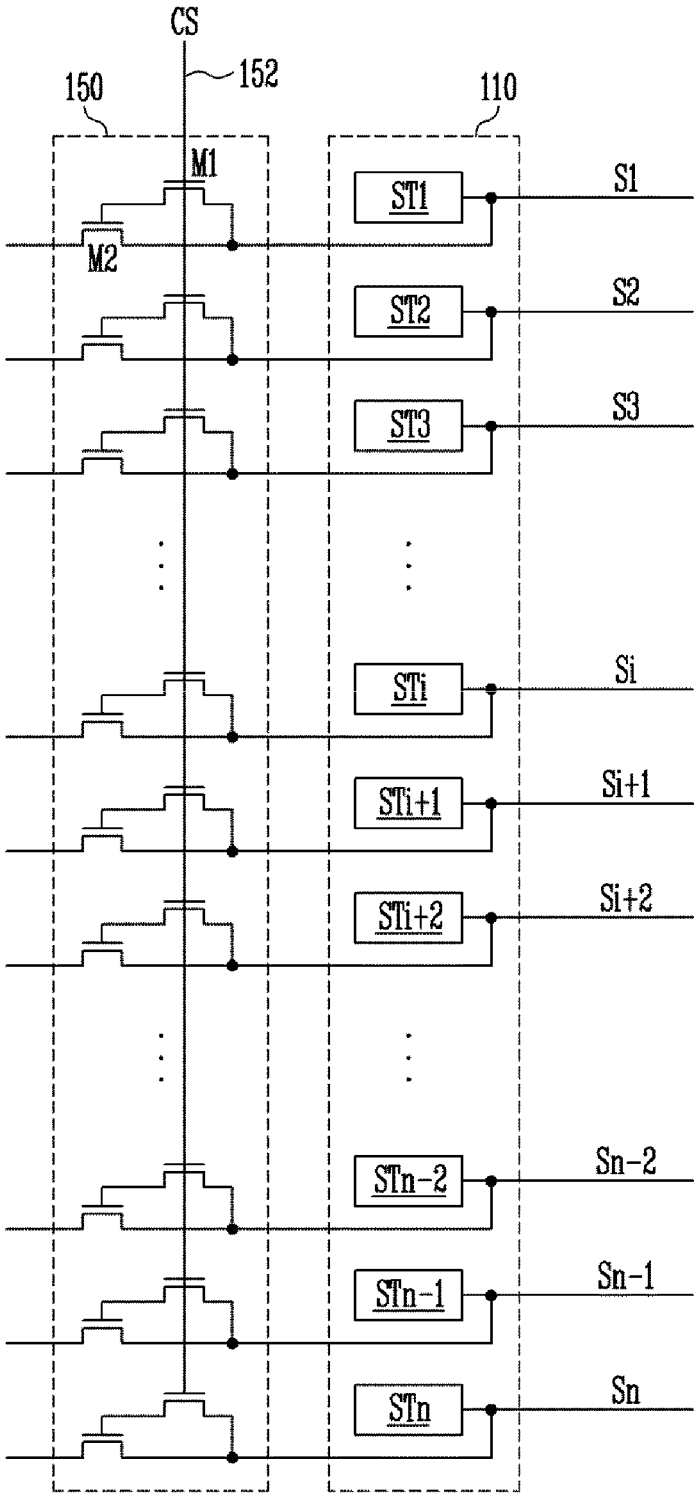
FIG. 3 is a view illustrating a configuration in which the detect line of FIG. 2 is cut.
Figure 4:
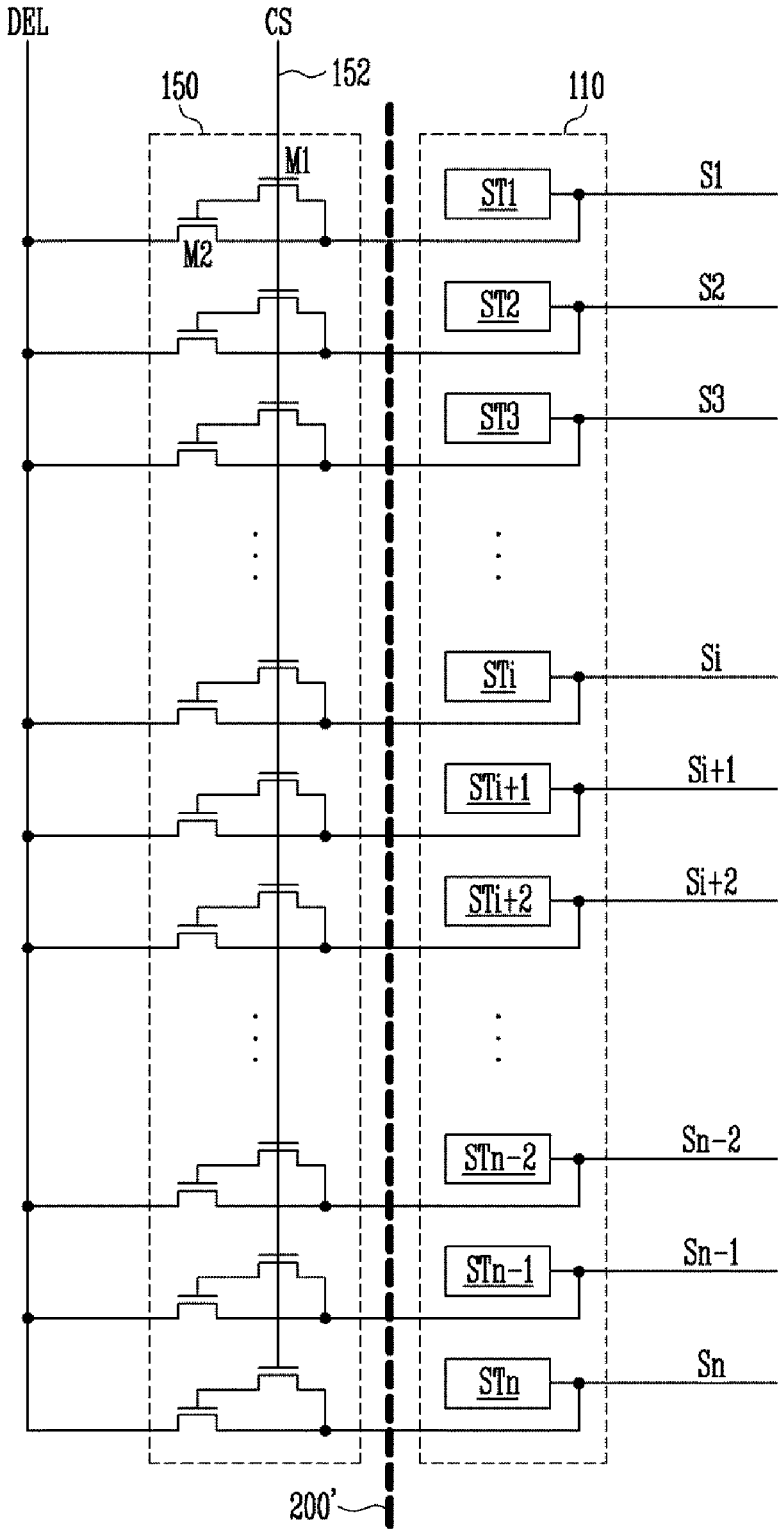
FIG. 4 is a view illustrating another embodiment of the cut line of FIG. 2.

The detect line DEL is removed from a panel along a cutting line after the inspection period, and accordingly, the detect line DEL is not included in the display device after the inspection period as illustrated in FIG. 3. Meanwhile, the first transistor M1 and the second transistor M2 are connected in the form of a diode, and thus, after the detect line DEL is cut, the first transistor M1 and the second transistor M2 may serve as a diode for preventing static electricity. In addition, the position of the cutting line may be adjusted. For example, as illustrated in FIG. 4, the inspection unit 150 may be removed by a cutting line 200'.

Figure 5:
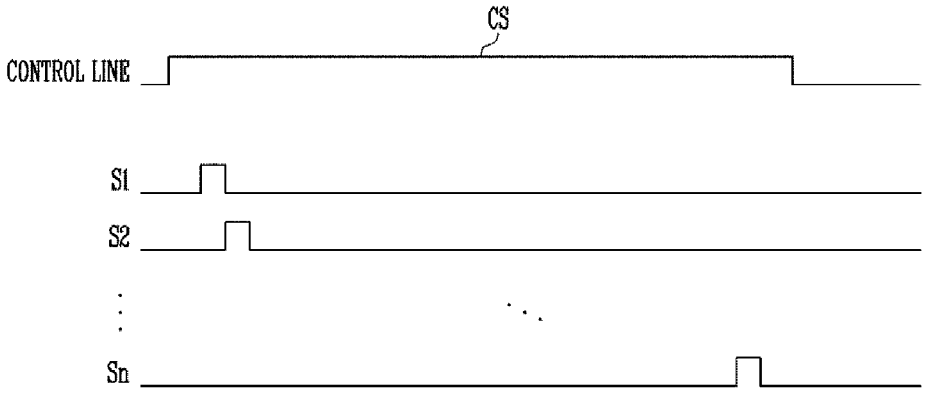
FIG. 5 is a view illustrating an embodiment of a control signal supplied in an inspection period.

FIG. 5 is a view illustrating an embodiment of a control signal supplied in an inspection period. In FIG. 5, it is illustrated that a scan signal is sequentially supplied to the scan lines S1 to Sn, although this is not a limitation of the present inventive concept.

Referring to FIG. 5, the control signal CS is supplied to the control line 152 during the inspection period. When the control signal CS is supplied to the control line 152, the first transistors M1 are turned on. When the first transistors M1 are turned on, the second transistors M2 included in the inspection unit 150 are connected in a diode form.

When the control signal is supplied to the control line 152, the stages ST1 to STn sequentially supply the scan signal to the scan lines S1 to Sn. The scan signal supplied to the scan lines S1 to Sn is supplied to the detect line DEL by way of the second transistors M2. Here, a defect of the stages ST1 to STn is detected by using a voltage of the scan signal supplied to the detect line DEL.

Figure 6:
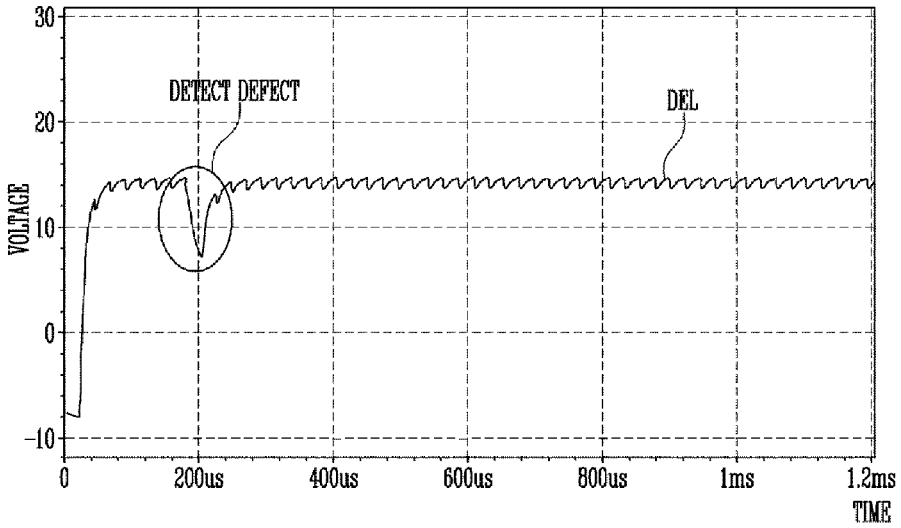
FIG. 6 is a view illustrating an example of a voltage of a detect line corresponding to a defect of a stage.

For example, as illustrated in FIG. 6, the voltage of the detect line DEL may be lowered at a particular point in time during the inspection period, as shown by the dip in FIG. 6. The dip, which in this case would be a "defect indicator," indicates that the stage that supplied the scan signal at the particular point in time did not output a normal scan signal. Thus, it is determined that the stage which has supplied the scan signal at the particular point in time is defective.

Figure 7:
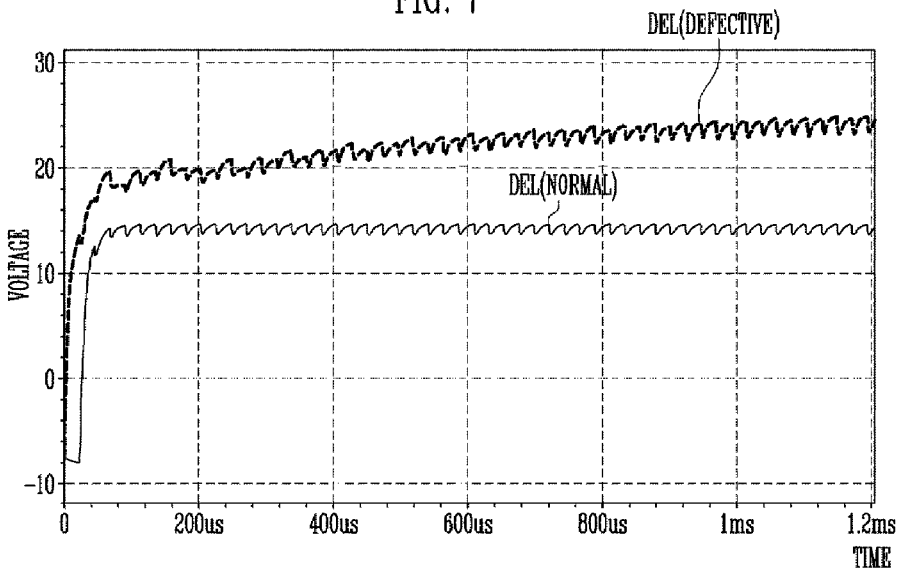
FIG. 7 is a view illustrating another example of a voltage of a detect line corresponding to a defect of a stage.

When a pull-up transistor (i.e., a transistor connected to the scan lines to supply a high voltage) included in each of the stages ST1 to STn is defective, as illustrated in FIG. 7, the voltage of the detect line DEL rises with the passage of time. This rise in voltage as shown by the upper plot in FIG. 7 is a "defect indicator." Hence, in the example shown, the scan driver 110 determines that a stage is defective, but it is not possible to determine the position of the defective stage (it could be any one of ST1 to STn). The present disclosure allows the position of the defective stage (any one of ST1 to STn) to be determined by controlling a supply period of the control signal CS.

Figure 8:
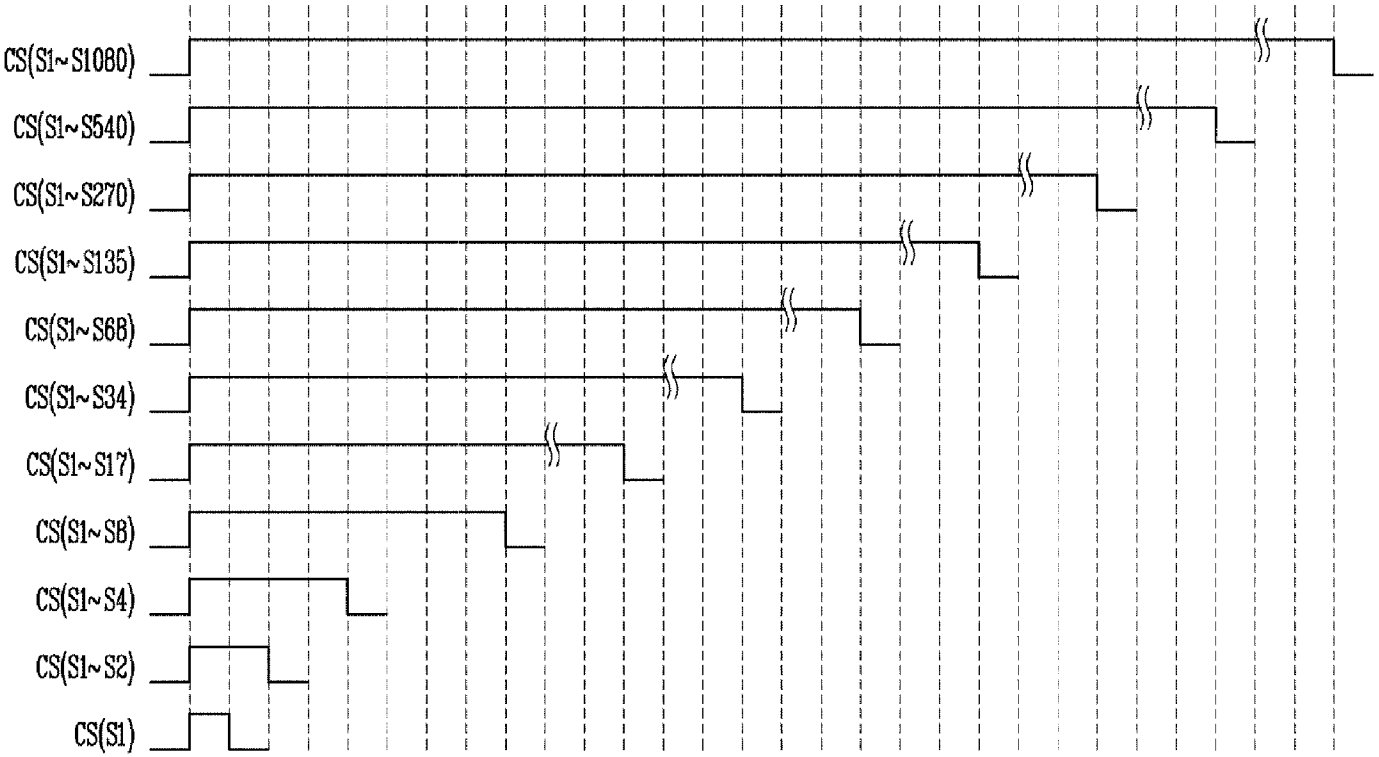
FIG. 8 is a view illustrating an embodiment of a supply period of a control signal to recognize a position of a defective stage.

FIG. 8 is a view illustrating an embodiment of a supply period of a control signal to recognize a position of a defective stage. In FIG. 8, for the purposes of description, n is set to 1080 and it is assumed that a first stage ST1 connected to the first scan line S1 is defective.

Referring to FIG. 8, first, the timing controller 130 supplies the control signal CS to the control line 152 during a period in which the scan signal is output from all the stages ST1 to STn. Here, as illustrated in FIG. 7, when a voltage of the detect line DEL rises with the passage of time, it is determined that the scan driver 150 is defective.

Thereafter, the timing controller 130 supplies the control signal CS to the control line 152 during a period (from S1 to S540) in which the scan signal is output in the first stage ST1 to $540^{th}$ stage ST 540 during a first frame period according to n/2, and supplies the control signal CS to the control line 152 during a period (from S541 to S1080) in which the scan signal is output from 541th stage ST541 to $1080^{th}$ stage ST1080 during a second frame period. In this example, it is supposed that the first stage ST1 is defective. Hence, the first stage ST1 to the $540^{th}$ stage ST540 are determined to be defective e.g., based on the rise in the detect line DEL voltage, and the $541^{st}$ stage ST541 and $1080^{th}$ stage ST 1080 are determined to be normal (in addition, when the first stage ST1 to the $540^{th}$ stage ST540 are determined to be defective, defect inspection may not be performed on the 541th stage ST541 and the $1080^{th}$ stage ST1080).

When the first stage ST1 to $540^{th}$ stage ST540 are determined to be defective, the timing controller 130 supplies the control signal CS to the control line 152 during the period (S1 to S270) in which the scan signal is output from the first stage ST1 to the $270^{th}$ stage ST270 in response to 540/2, and supplies the control signal to $271^{st}$ stage ST271 to $540^{th}$ stage ST540 during a period (S271 to S540) in which the scan signal is output from $271^{st}$ stage ST271 to $540^{th}$ stage ST 540 during a next frame period. Then, the first stage ST1 to $270^{th}$ stage ST270 are determined to be defective based on a defect indicator (e.g., the rise in the detect line DEL voltage), and the $271^{st}$ stage ST271 to the $540^{th}$ stage ST540 are determined to be normal.

When the first stage ST1 to $270^{th}$ stage ST270 are determined to be defective, the timing controller 130 supplies the control signal CS to the control line 152 during a period (S1 to S135) in which the scan signal is output from the first stage ST1 to S135$^{th}$ stage ST135 in response to 270/2, and supplies the control signal CS to the control line 152 during a period (S136 to S270) in which the scan signal is output from the $136^{th}$ stage ST136 to the $270^{th}$ stage ST270 during a next frame period. Then, the first stage ST1 to the $135^{th}$ stage ST135 are determined to be defective, and the $136^{th}$ stage ST136 to the $270^{th}$ stage ST270 are determined to be normal.

When the first stage ST1 to the $135^{th}$ stage ST135 are determined to be defective, the timing controller 130 supplies the control signal CS to the control line 152 during a period (S1 to S68) in which the scan signal is output from the first stage ST1 to $68^{th}$ stage ST68 according to 135/2 (e.g., round off), and supplies the control signal CS to the control line 152 during a period (S69 to S135) in which the scan signal is output from the $69_{th}$ stage ST69 to the $135^{th}$ stage ST135 during a next frame period. Then, the first stage ST1 to the $68^{th}$ stage ST69 are determined to be defective (e.g., based on a climbing voltage on the DEL line), and the $69^{th}$ stage ST69 to the $135^{th}$ stage ST135 are determined to be normal.

When the first stage ST1 to the $68^{th}$ stage ST68 are determined to be defective, the timing controller 130 supplies the control signal CS to the control line 152 during a period of the frame (S1 to S34) in which the scan signal is output from the first stage ST1 to $34^{th}$ stage ST34 according to 68/2, and supplies the control signal CS to the control line 152 during a period of the frame (S35 to S68) in which the scan signal is output from the $35^{th}$ stage ST35 to the $68^{th}$ stage ST68. In this example, the first stage ST1 to the $34^{th}$ stage ST34 are determined to be defective, and the $35^{th}$ stage ST35 to the $68^{th}$ stage ST68 are determined to be normal.

When the first stage ST1 to the $34^{th}$ stage ST34 are determined to be defective, the timing controller 130 supplies the control signal CS to the control line 152 during a period (S1 to S17) in which the scan signal is output from the first stage ST1 to $17^{th}$ stage ST17 according to 34/2, and supplies the control signal CS to the control line 152 during a period (S18 to S34) in which the scan signal is output from the $18^{th}$ stage ST18 to the $34^{th}$ stage ST34 during a next frame period. Then, the first stage ST1 to the $17^{th}$ stage ST17 are determined to be defective, and the $18^{th}$ stage ST18 to the $34^{th}$ stage ST34 are determined to be normal.

When the first stage ST1 to the $17^{th}$ stage ST17 are determined to be defective, the timing controller 130 supplies the control signal CS to the control line 152 during a period (S1 to S8) in which the scan signal is output from the first stage ST1 to $8^{th}$ stage ST8 according to 17/2 (lowered), and supplies the control signal CS to the control line 152 during a period (S9 to S17) in which the scan signal is output from the $9^{th}$ stage ST9 to the $17^{th}$ stage ST17 during a next frame period. Then, the first stage ST1 to the $8^{th}$ stage ST8 are determined to be defective, and the $9^{th}$ stage ST9 to the $17^{th}$ stage ST17 are determined to be normal.

When the first stage ST1 to the $8^{th}$ stage ST8 are determined to be defective, the timing controller 130 supplies the control signal CS to the control line 152 during a period (S1 to S4) in which the scan signal is output from the first stage ST1 to $4^{th}$ stage ST4 according to 8/2, and supplies the control signal CS to the control line 152 during a period (S5 to S8) in which the scan signal is output from the $5^{th}$ stage ST5 to the $8^{th}$ stage ST8 during a next frame period. Then, the first stage ST1 to the $4^{th}$ stage ST4 are determined to be defective, and the $5^{th}$ stage ST5 to the $8^{th}$ stage ST8 are determined to be normal.

When the first stage ST1 to the fourth stage ST4 are determined to be defective, the timing controller 130 supplies the control signal CS to the control line 152 during a period (S1 and S2) in which the scan signal is output from the first stage ST1 and second stage ST2 according to 4/2, and supplies the control signal CS to the control line 152 during a period (S3 and S4) in which the scan signal is output from the third stage ST3 and fourth stage ST4 during a next frame period. Then, the first stage ST1 and the second stage ST2 are determined to be defective, and the third stage ST3 and the fourth stage ST4 are determined to be normal.

Thereafter, the timing controller 130 supplies the control signal CS to the control line 152 during a period in which the scan signal is output from the first stage ST1, and supplies the control signal CS to the control line 152 during a period in which the scan signal is output from the second stage ST2 during a next frame period. Then, it may be checked that a desired scan signal is not output from the first stage ST1 and a defect of the first stage ST1 may be detected accordingly.

In the manner described above, the inventive concept allows the determination of a position of a final, defective stage while reducing the supply period of the control signal CS. In the embodiment disclosed above, the supply period of the control signal CS is halved by using the timing controller 130.

Figure 9:
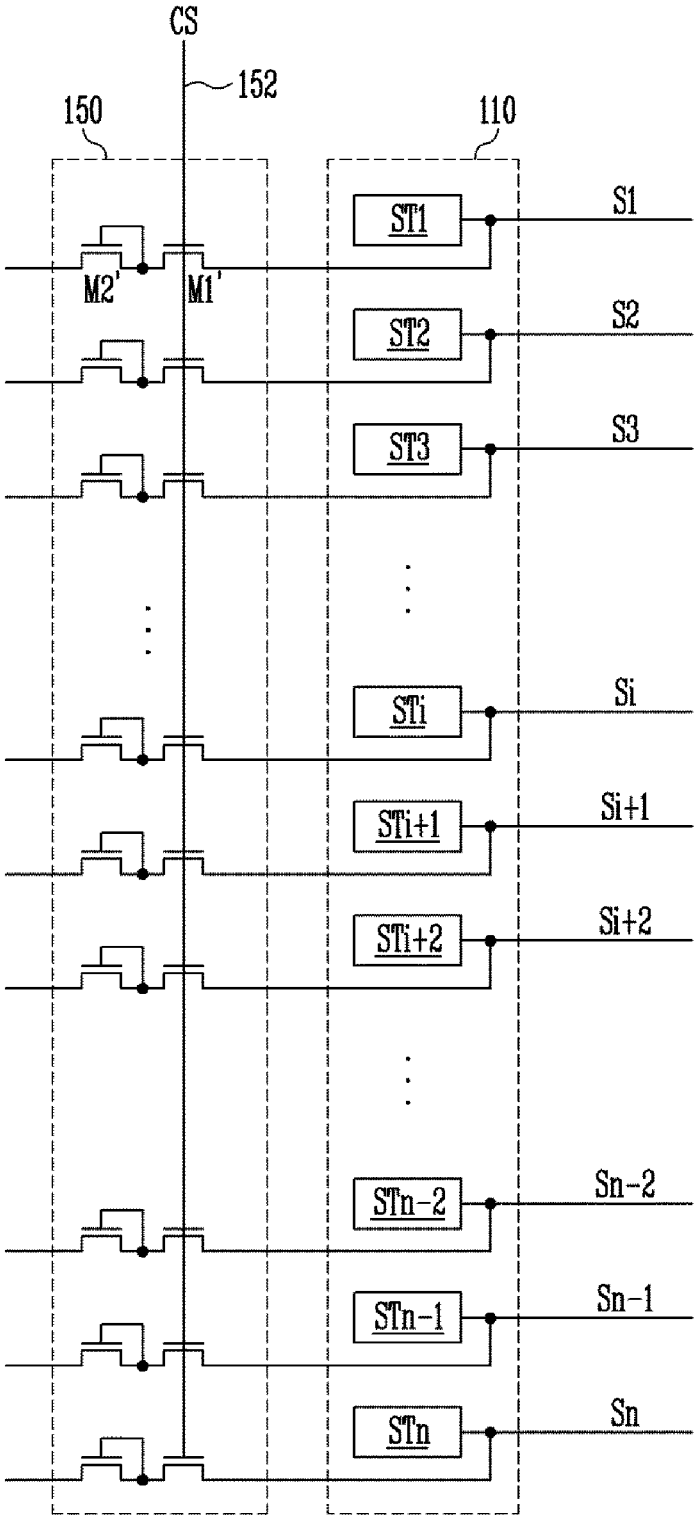
FIG. 9 is a view illustrating a second embodiment of the inspection unit of FIG. 1.

FIG. 9 is a view illustrating a second embodiment of the inspection unit of FIG. 1.

Referring to FIG. 9, the inspection unit 150 according to the second embodiment of the present invention includes a first transistor M1' and a second transistor M2' connected to an output terminal of each of stages ST1 to STn.

A first electrode of the first transistor M1' positioned in ith horizontal line is connected to an output terminal of ith stage STi, and a second electrode is connected to a first electrode and a gate electrode of the second transistor M2' positioned in the ith horizontal line. The first transistor M1' is turned on when the control signal CS is supplied, to electrically connect the second transistor M2' and the stage STi.

The first electrode and the gate electrode of the second transistor M2' positioned in the ith horizontal line are connected to a second electrode of the first transistor M1' positioned in the ith horizontal line. A second electrode of the second transistor M2' positioned in the ith horizontal line is connected to a detect line (not shown). That is, the second transistor M2' has a diode form such that a current flows to the detect line from the stage STi. In addition, since the detect line is removed from the panel after the inspection period, the detect line is not illustrated in FIG. 9.

The inspection unit according to the second embodiment detects a defect of the stages ST1 to STn through the same process as that of the inspection unit according to the first embodiment illustrated in FIG. 2. Hence, a detailed description thereof will be omitted.

Figure 10:
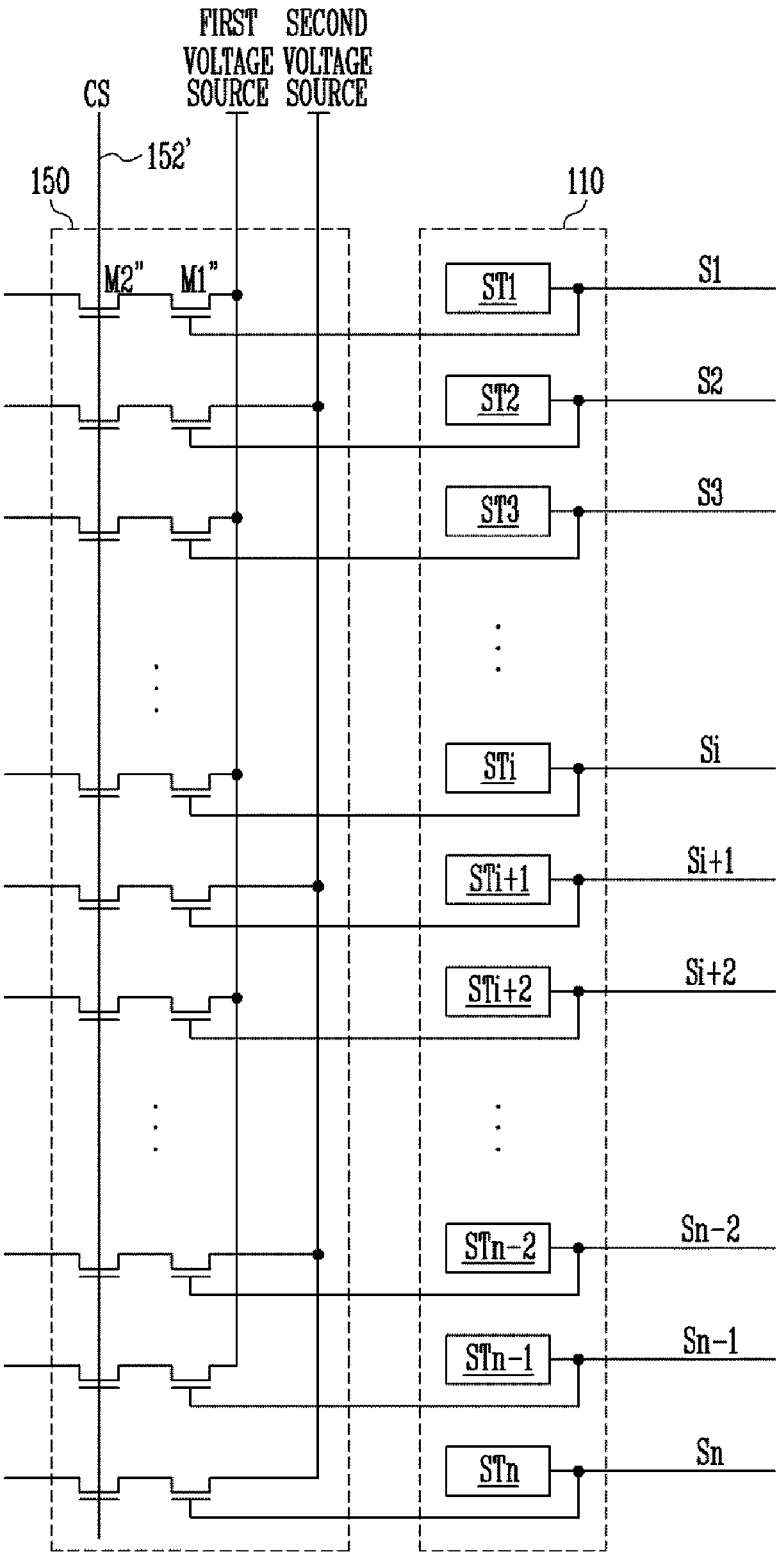
FIG. 10 is a view illustrating a third embodiment of the inspection unit of FIG. 1.

FIG. 10 is a view illustrating a third embodiment of the inspection unit of FIG. 1.

Referring to FIG. 10, an inspection unit 150 according to the third embodiment includes a first transistor M1" and a second transistor M2" connected to an output terminal of each of the stages ST1 to STn.

A gate electrode of the first transistor M1" positioned in ith horizontal line is connected to an output terminal of ith stage STi, and a second electrode is connected to a first electrode of the second transistor M2" positioned in ith horizontal line. In this case, the first transistors M1" may be sequentially turned on in response to a scan signal output from the stages ST1 to STn.

A first electrode of a first transistor M1" positioned in an odd-numbered horizontal line is connected to a first voltage source and a first electrode of a first transistor M1" positioned in an even-numbered horizontal line is connected to a second voltage source having a voltage different from that of the first voltage source. For example, the first voltage source may be set to have a low voltage, and the second voltage source may be set to have a high voltage higher than that of the first voltage source.

Figure 11:
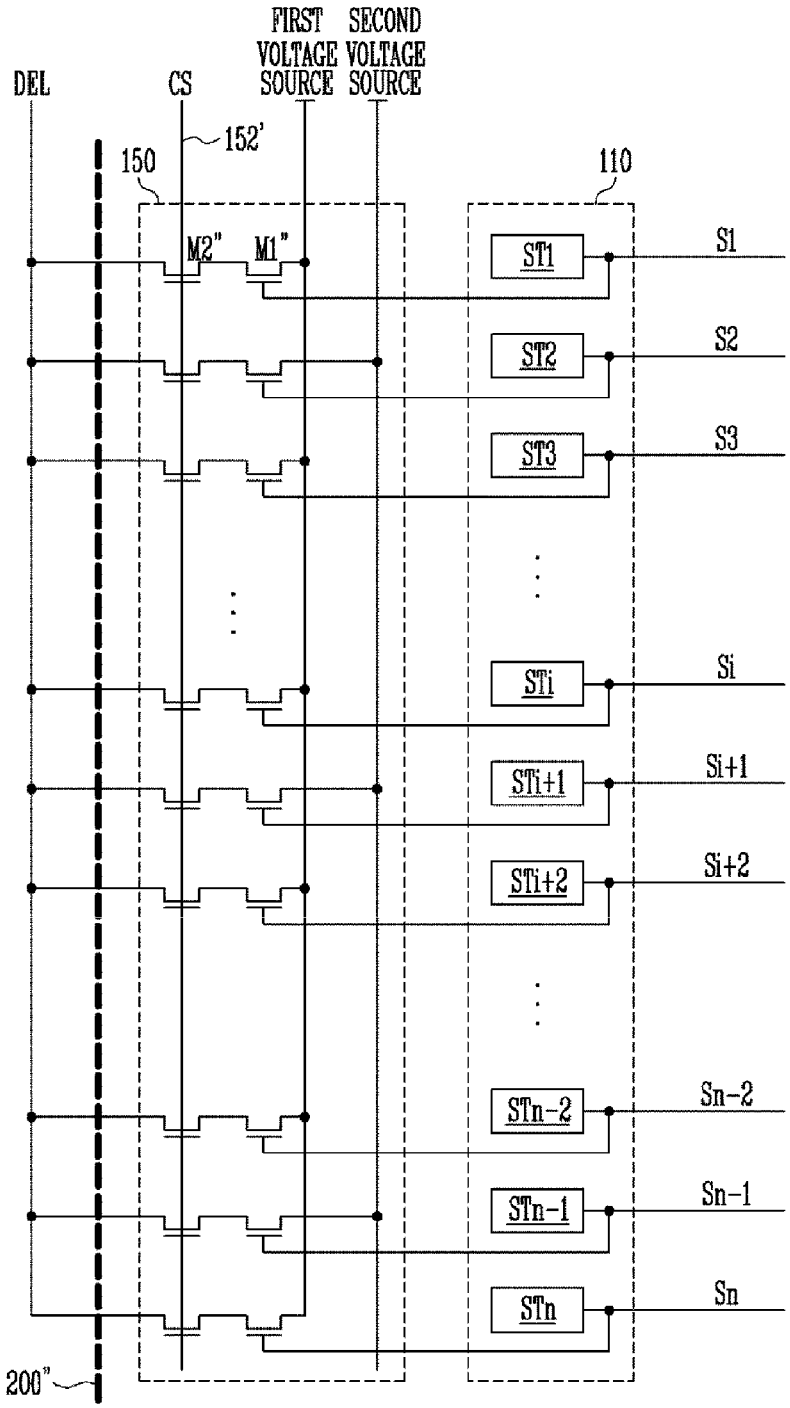
FIG. 11 is a view illustrating a configuration in which a detect line is connected to the inspection unit of FIG. 10.

A first electrode of a second transistor M2" positioned in ith horizontal line is connected to the second electrode of the first transistor M1" positioned in the ith horizontal line, and a second electrode is connected to the detect line DEL as illustrated in FIG. 11. The second transistor M2" is set to be turned on when the control signal CS is supplied to a control line 152', and set to be turned off when the control signal CS is not supplied.

The detect line DEL receives voltages from the first voltage source and the second voltage source in response to the first transistors M1" sequentially turned on during an inspection period. In this case, whether the stages ST1 to STn are defective may be detected, while checking the voltages supplied to the detect line DEL.

After the inspection period, the detect line DEL is removed from the panel, and accordingly, the detect line DEL is not included in the display device after the inspection period. In addition, the position of the cutting line may be variously set. For example, after the inspection period, the first transistors M1" and the second transistors M2" may also be removed.

Referring to an operational process, the control signal CS is supplied to the control line 152' and a scan signal is sequentially output from the stages ST1 to STn as illustrated in FIG. 5.

Figure 12:
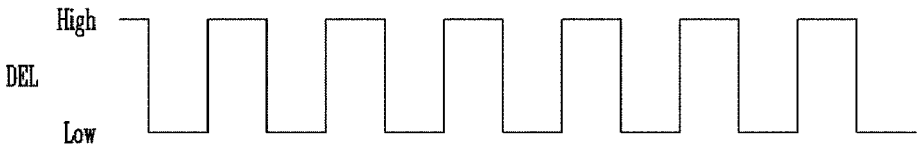
FIG. 12 is a view illustrating an embodiment of a detect line voltage corresponding to the inspection unit of FIG. 10.

When the control signal CS is supplied to the control signal 152', the second transistors M2" are set to be turned on. When a scan signal is sequentially output from the stages ST1 to STn, the first transistors M1" are sequentially turned on. When the first transistors M11" are sequentially turned on, voltages of the first voltage source and the second voltage source are sequentially output to the detect line DEL as illustrated in FIG. 12. Here, when a particular stage is defective, a voltage of the detect line DEL is not changed to a desired form, and thus, the defective particular stage may be detected.

Figure 13:
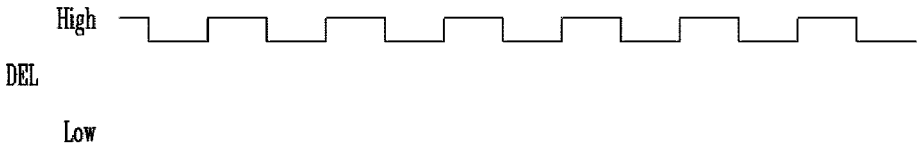
FIG. 13 is a view illustrating another embodiment of a detect line voltage corresponding to the inspection unit of FIG. 10.

When a pull-up transistor (i.e., a transistor connected to the scan line and supplying a high voltage) included in each of the stages ST1 to STn is defective, the voltage of the detect line DEL does not fall to the voltage of the second voltage source as illustrated in FIG. 13. In this case, as illustrated in FIG. 8, the defective stage is detected, while halving the supply period of the control signal CS.

By way of summation and review, in general, a display device includes a data driver for supplying a data signal to data lines, a scan driver for supplying a scan signal to scan lines, and a pixel unit including a plurality of pixels connected to the data lines.

When the scan signal is supplied to the scan lines, pixels included in the pixel unit are selected to receive a data signal from the data lines. When the data signal is received, the pixels supply light having luminance corresponding to the data signal to the outside.

The scan driver includes stages connected to the scan lines, respectively. The stages supply a scan signal to scan lines connected thereto in response to signals from a timing controller. To this end, each of the stages may include a P-type (e.g., PMOS) and/or N-type (e.g., NMOS) transistor, and may be simultaneously mounted on a panel together with the pixels.

When the scan driver is mounted on the panel, whether the scan driver is defective is detected by using presence or absence of an error of light generated by the pixels (Visual test). However, when a defective scan driver is detected by using light generated by the pixels, a process of the pixels should be completed. That is, an additional process such as a liquid crystal injection process, or the like, should be performed on a panel having a defective scan driver, causing unnecessary loss. Thus, a method for detecting a defect of transistors forming the scan driver is required.

According to the display device and the method of inspecting the same of embodiments of the present invention, whether the scan driver is defective may be detected by using a scan signal output from each of the stages. Also, in the present invention, a position of a defective stage may be recognized, while reducing a supply period of a control signal supplied to the inspection unit.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device comprising:

pixels electrically connected to scan lines and data lines;

a scan driver including a plurality of stages connected to the scan lines;

an inspection unit connected to the stages to detect whether the stages are defective based on a scan signal received from each of the plurality of stages, and an output of each stage being connected to a second electrode of first transistors and second transistors within the inspection unit; wherein a gate of the first transistors is connected to a control signal line, a first electrode is connected to a gate of the second transistors; wherein a first electrode of the second transistors is connected to a detect line, a second electrode of the second transistors is connected to the second electrode of the first transistors and forms a diode when the first transistors receive a control signal during an inspection period; and a timing controller supplying the control signal to the control signal line, wherein the timing controller detects a position of a defective stage by reducing a period during which the control signal is supplied.

2. The display device of claim 1, wherein the timing controller supplies the control signal during a period in which a scan signal is supplied in every stage, and in response to determining that at least one stage is defective, the timing controller reduces a supply period of the control signal.

3. A display device comprising:

pixels positioned in regions demarcated by scan lines and data lines;

a scan driver including stages connected to the scan lines;

an inspection unit including a gate of first transistors respectively connected to the stages to detect whether the stages are defective based on a scan signal received from each of the plurality of stages and second transistors respectively connected to the first transistors and turned on in response to receiving a control signal at a gate of the second transistors and the second transistors connected to a detect line;

wherein a gate electrode of ith first transistor is directly connected to an output terminal of ith stage, first electrodes of first transistors connected to odd-numbered stages are connected to a first voltage source, and first electrodes of first transistors connected to even-numbered stages are connected to a second voltage source having a voltage different from a voltage of the first voltage source; wherein i is a natural number; and a timing controller supplying the control signal to the control signal line, wherein the timing controller detects a position of a defective stage by reducing a period during which the control signal is supplied.

4. The display device of claim 1, wherein the timing controller detects the position of the defective stage based on a voltage of the detect line.

5. The display device of claim 3, wherein a first electrode of ith second transistor is connected to a second electrode of the ith first transistor.

6. The display device of claim 3, wherein the timing controller supplies the control signal during a period in which a scan signal is supplied in every stage, and in response to determining that at least one stage is defective, the timing controller reduces a supply period of the control signal.

7. The display device of claim 3, wherein the timing controller detects the position of the defective stage based on a voltage of the detect line.

8. A method of inspecting a display device including stages for supplying a scan signal, the method comprising:

setting first transistors to an ON state by supplying a control signal to a control signal line connected to a gate of first transistors;

an output of each stage being connected to a second electrode of first transistors and second transistors within the inspection unit; wherein a gate of the first transistors is connected to a control signal line, a first electrode is connected to a gate of second transistors; wherein a first electrode of the second transistors is connected to a detect line, a second electrode of the second transistors is connected to the second electrode of the first transistors and forms a diode when the first transistors receive the control signal during an inspection period; and inspecting whether the stages are defective during the inspection period by using a voltage supplied by the stages to the detect line, wherein in response to a determination that at least one of the stages is defective, a position of the defective stage is detected by reducing a supply period of the control signal.

9. The method of claim 8, wherein after inspecting whether the stages are defective, the detect line is cut away from a panel leaving the first transistors and the second transistors to serve as a diode for preventing static electricity.

10. The method of claim 8, wherein after inspecting whether the stages are defective, the detect line and the first transistors and second transistors are cut away from the panel.

* * * * *